US005887696A

United States Patent [19]

Goetz

[11] Patent Number: 5,887,696

[45] Date of Patent: Mar. 30, 1999

[54] ALUMINUM CAN RECYCLING CENTER

[76] Inventor: Joseph R. Goetz, 550 E. Encinas Ave., Gilbert, Ariz. 85234

[21] Appl. No.: 735,704

[22] Filed: Oct. 23, 1996

[51] Int. Cl.[6] ..... G07F 7/06

[52] U.S. Cl. ..... 194/208; 221/185

[58] Field of Search ..... 194/205, 208, 194/209, 212, 213; 100/210, 902; 198/814; 222/233, 608; 221/185

[56] References Cited

U.S. PATENT DOCUMENTS

| | | | |
|---|---|---|---|
| 2,413,265 | 12/1946 | Thompson | 198/814 |
| 3,140,677 | 7/1964 | Fraser | 222/233 X |
| 3,422,953 | 1/1969 | Gates et al. | 198/814 X |
| 4,257,511 | 3/1981 | Miller | 194/209 |
| 4,896,791 | 1/1990 | Smith | 221/7 |
| 4,967,928 | 11/1990 | Carter | 221/185 X |
| 5,052,547 | 10/1991 | Doi | 198/814 X |
| 5,195,429 | 3/1993 | Firpo | 100/902 X |
| 5,469,783 | 11/1995 | Fry | 100/902 X |

*Primary Examiner*—F. J. Bartuska

[57] ABSTRACT

An aluminum can recycling center for receiving aluminum cans from individual consumers, preparing the cans to be recycled and compensating the consumer for the recycle value of the aluminum comprising coupon display and dispensing, an improved aluminum can sorter and a unique aluminum can crusher is disclosed.

6 Claims, 5 Drawing Sheets

ALUMINUM CAN RECYCLING CENTER

FIELD OF THE INVENTION

This invention is a system and an apparatus for receiving aluminum cans from individual consumers, preparing the cans to be recycled and compensating the consumer for the recycle value of the aluminum.

BACKGROUND OF THE INVENTION

Recycling of aluminum cans is a major source of aluminum for aluminum foundries, etc., and a major industry. One of the very important sources of aluminum is the recycling of soft drink and beer cans by consumers.

Many types of systems and devices are described in the patent and industrial literature for separating aluminum cans and other aluminum articles from ferrous metals, bottles, etc. Most of these devices are very large and are adapted for use only in recycling yards for processing tons of material per day.

Americans and people around the world are becoming increasingly aware of the need to recycle their waste products. Aluminum cans have significant economic value and many people sell their own used cans and collect cans from others for sale to recycling yards. Efforts have been made to provide recycling facilities in convenient locations, such as super markets and other places frequented by consumers.

Even though consumer recycling did not become popular until about two decades ago, the overall concepts of the technology have been thoroughly developed and many systems and devices have been designed to collect recycled products, separate the products, etc. Indeed, this is a crowded art.

Notwithstanding the many approaches to consumer recycling stations, there remains a great need for an attractive, simple, reliable and economically beneficial system for receiving recycled aluminum cans and for compensating consumers for their aluminum cans.

One of the major drawbacks to consumer recycling systems is that they are unsightly and, consequently, are relegated to back corners of parking lots and in other places which are hard to see and/or hard for the consumer to get to. Merchants, grocery store owners and managers and shopping mall managers, are not receptive to having recycling centers near the entrance to their business establishments because they occupy space that could be used for dispensing or selling goods or for other commercially profitable uses. It is a feature of this invention that a system is provided that enables the merchant to offer recycling services and to benefit from the presence of an aluminum can recycling center that is aesthetically attractive and, hence, can be conspicuously placed near the entrance to a store or mall.

SUMMARY OF THE INVENTION

An aluminum can recycling center is described and claimed as an embodiment of the invention. The recycling center comprises a housing which comprises at least one door and means for locking the door for permitting access to the interior of the housing only to authorized individuals. A recessed box is secured to the housing, being constructed and configured to define an operating center which has generally vertical walls and a generally horizontal counter top. A multiplicity of displays identifying coupons available from the aluminum can recycling center are mounted on at least one wall. Means are provided for receiving, sorting and counting aluminum cans and, thereafter, for crushing aluminum cans and transporting the crushed aluminum cans to a recycle bin. The bin is periodically emptied and the aluminum recycled. The user, i.e., the individual depositing cans for recycling, is paid the recycle value of the aluminum through a coin dispenser or by a printed voucher which can be redeemed in the store at which the recycle center is located, or elsewhere. Means are provided in the operating center for selecting the coupons desired by the user for redemption in the store or at any place of business advertising in the recycle center, or simply for providing the user information, e.g., game schedules, TV programing schedules, etc.

An unbreakable transparent cover for the displays is provided along with means securing the cover over the displays for preventing removal of the cover except by authorized individuals.

The aluminum can sorter comprises a continuous conveyor belt carried on a pair of rollers, one of which rollers is supported by a shaft mounted at each end by an over-center, spring biased bearing assembly, the assembly comprising a bearing for the shaft, a bias spring on a shank, and an over-center fastener for applying biasing force to the spring.

The crusher comprises a rotatably driven crushing drum, a crushing anvil constructed and positioned to define a space between the anvil and the drum substantially the thickness of a crushed aluminum can, and a spring loaded structure strongly biasing the anvil toward the drum for permitting the anvil to move away from the drum only when an object larger and more solid than a crushed aluminum can enters the space between the drum and the anvil. A new and unique crusher design is preferably utilized in this invention.

In the preferred embodiment, the crusher comprises a drum having a plurality of rectangular or arcuate cross-sectioned shoes mounted thereon, each of the shoes comprising one or more projections for grabbing the cans and carrying them through the crusher nip.

The crusher may comprise guide means movably mounted over approximately half of the crusher drum to prevent cans from entering the space on the side of the drum distal from the anvil. In the preferred embodiment the guide means slopes toward the anvil and contacts and is vibrated by the drum thereby bouncing any cans that may contact the guide means toward the anvil.

DESCRIPTION OF THE PREFERRED EMBODIMENT

Figure 1:
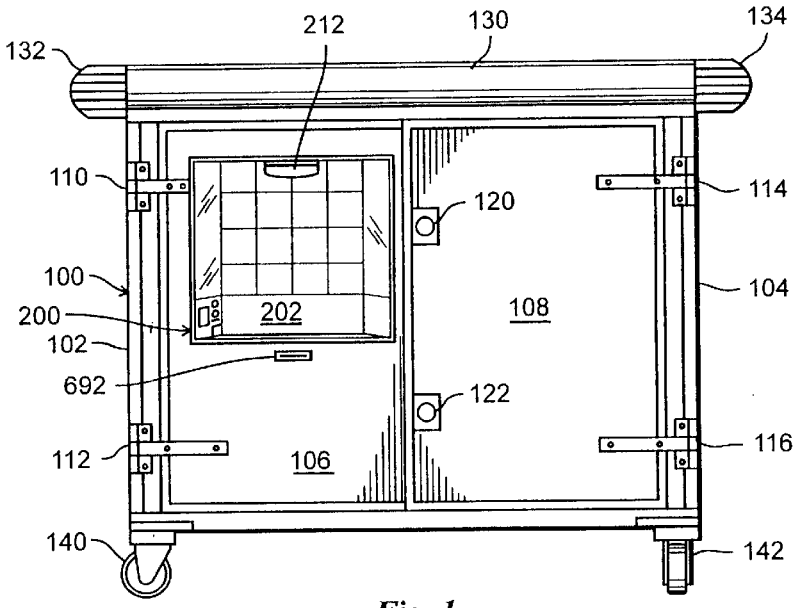
FIG. 1 depicts in front elevation the aluminum can recycling center of this invention, showing the same closed up as it would appear to a user.

The exemplary embodiment of the invention shown in the drawings is described in detail as the best mode presently known to the inventor and to enable anyone skilled in the art to make and use the invention. The invention is not limited to this embodiment, however, and many variations, especially as to individual components may be made without departing from the invention.

Figure 2:
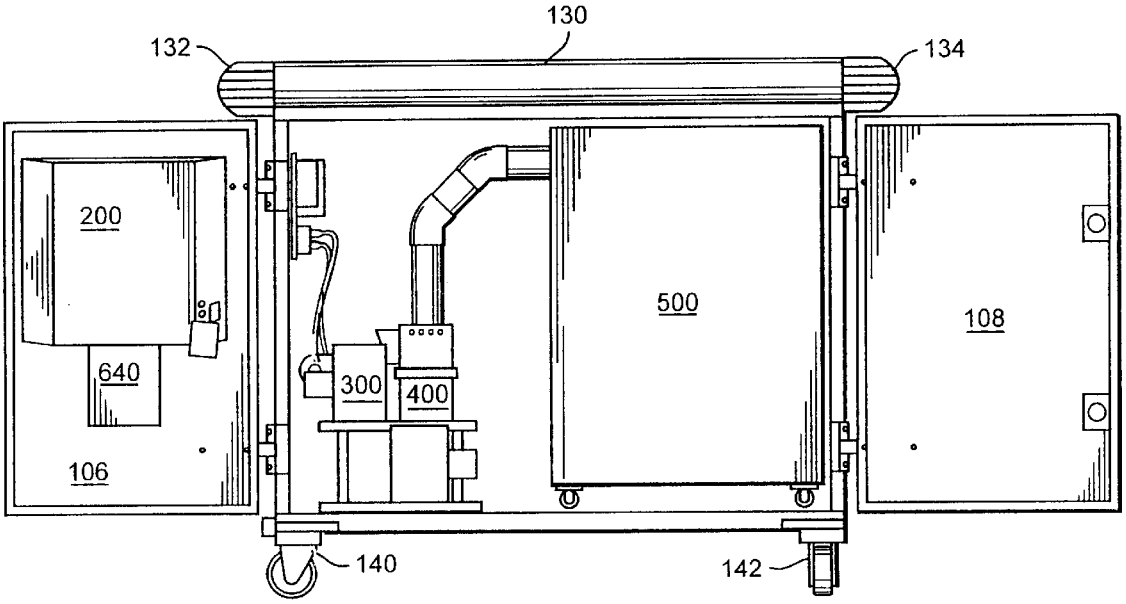
FIG. 2 depicts in front elevation the aluminum can recycling center of this invention with the doors open showing the internal structure and components.

Referring first to FIGS. 1–4, the invention is a moveable aluminum can recycling center comprising a housing 100, an aluminum can sorter 300, shown in FIG. 2, and an aluminum can crusher system 400 for feeding crushed aluminum cans to a recycle receptacle 500.

The housing 100 comprises a rectangular box having a front left edge 102 and a front right edge 104, as the housing is depicted in FIGS. 1 and 2. A pair of doors 106 and 108 are supported, respectively by hinges 110 and 112 on the left and 114 and 116 on the right. A Pair of high-security locks 120 and 122, or other securing mechanisms to permit the doors to be securely locked to prevent entrance to the interior of the housing except to authorized individuals are provided.

As shown in FIG. 2, these hinges swing the doors outwardly to the left and right respectively and thereby permit the doors to be swung against the left and right ends, respectively, of the housing. The doors are conveniently equal in width, but one door may be wider than the other if desired.

A light bar 130 which may comprise a plurality of fluorescent or incandescent lamps, colored lighting, etc., and a light-diffusing transparent or translucent cover is provided along the top edge of the housing. Ornamental light-conducting sets of plates 132 and 134 give the aluminum can recycling center an aesthetically attractive appearance. Similar, but shorter light bars are provided at each end of the housing and, if the housing is visible, may be provided on the back side of the housing. The back side of the housing may, in some environments, carry notices and advertisements.

Figure 3:
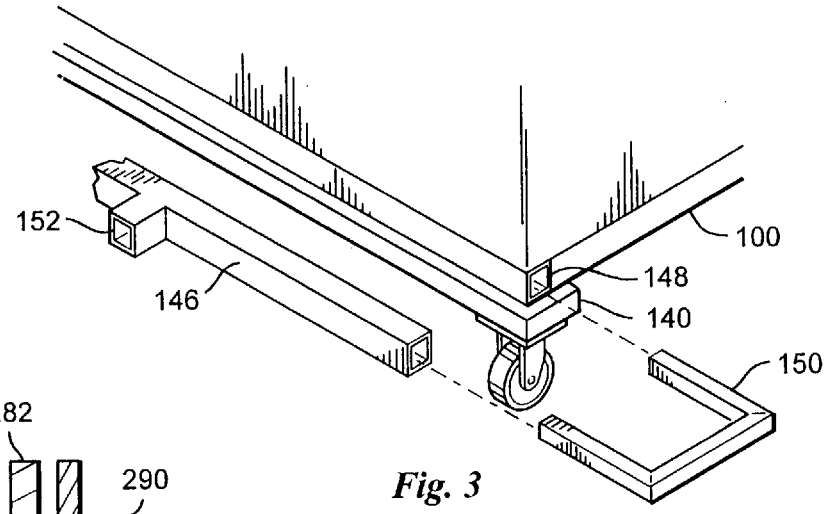
FIG. 3 depicts the construction of means for supporting and moving the aluminum can recycling center of this invention.

The housing is supported on left end beam 140 and right end beam 142, each of which comprises a pair of casters. FIG. 3 depicts in enlarged, exploded and partially broken view, the operative elements of the left end support beam 140. The beams 140 and 142 are identical and interchangeable. Ane conventional means for connecting the beams to the housing may be used.

In the preferred embodiment, housing is configured and constructed to define in its bottom frame structure a passage or an opening extending from the front and back sides, respectively, toward the center of the housing. A towing and/or lifting beam 146 is secured at each end into these openings, one of which is shown at 148, by a U-fastener 150. The U-fastener extends into the hollow end of beam 146 and into the opening 148. A jack can then be attached to the beam 146 for lifting the housing to permit the beam 140 with its casters to be mounted under the end of the housing, or for removing the beam 140 for permanently locating the recycling center. A tow bar 152 may be secured to the beam 146 to permit the recycle center to be towed by a lift truck, etc., on the casters. The casters swivel to permit turning.

Figure 4:
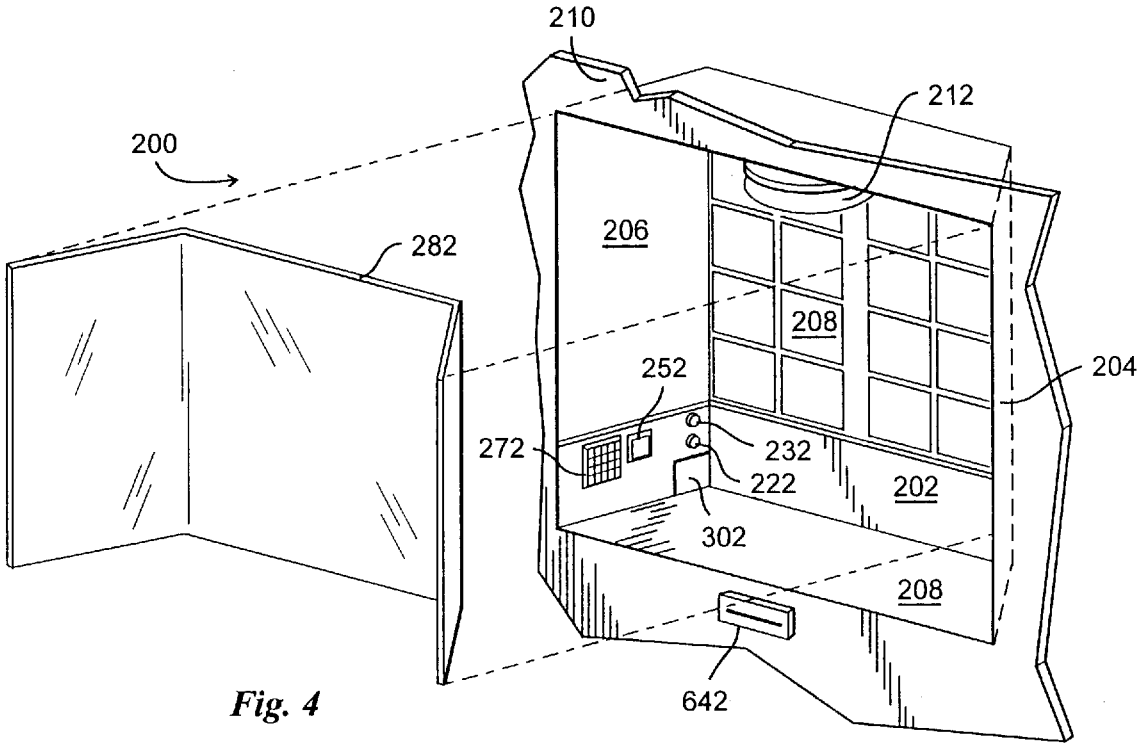
FIG. 4 depicts in exploded perspective view the front of the operating center of the aluminum can recycling center of this invention.

An operating center 200 is built into or attached to the door 106. The operating center 200 is positioned and constructed to permit the user, a person or persons desiring to recycle aluminum cans, to deposit their aluminum cans and receive either cash or vouchers, as will be described more fully hereinafter, in return for the aluminum cans. Referring principally now to FIGS. 1, 2 and 4, it will be seen that the operating center comprises an open front box defined by a back wall 202, side walls 204 and 206 extending outwardly from the back wall, preferably at an angle generally from about 30 to about 60 degrees, typically about 45 degrees, to define an open front that is wider than the width of the back wall, a bottom 208 and a top 210, to which a light fixture 212 may be fixed. The bottom 208 is constructed and configured to form a counter top where the user transacts his or her business.

The housing is preferably made of heavy duty steel sheeting and the operating center box is preferably made of stainless steel. The entire housing may, of course, be made of stainless steel and/or the operating center box may be made of steel sheeting that is painted a desired decorative color. It is particularly desirable, however, to provide an easily cleanable counter area and stainless steel provides this very desirable characteristic. For economy, the bottom of the operating center box may be made of stainless steel and the remainder of the housing made of steel. Other materials may, of course, be used but steel and stainless steel provide high strength and vandal resistance.

The user may request audible instructions by pushing an INFO button 222. To deposit aluminum cans, the user presses the"START" button 232 and inserts the aluminum cans to be recycled through the passage 302. The objects inserted by the user are first sorted and only aluminum cans are accepted. Steel cans, bottles, etc., are sent to a reject bin. The aluminum cans are counted and crushed and sent to a recycle bin. The user is paid in cash by way of coins deposited in the coin tray 252 or by printed voucher from slot 642. Once the payment is made in cash or by voucher, the system resets and is ready to receive aluminum cans from another user.

The user may also select coupons by entering the coupon number on a key pad selector 272. The number of each advertisement, exemplary of which is advertisement 280, is part of the advertising display. The operating center displays a multiplicity of coupon offers. A polycarbonate sheet 282, or a sheet of other tough transparent polymer is configured to fit into at least the upper portion of the operating box is provided for covering the coupon advertisements. A sheet of polycarbonate ⅛ inch thick, or greater, is virtually indestructible and protects the printed material from all but the most dedicated and well-equipped vandal. The polycarbonate protective cover is secured into the operating center by any desired means that prevents its removal by other than authorized individuals. A frame mounted by smooth headed screws, or screws whose head is not accessible from outside, which can be loosened only from the back side of the door provides a convenient mounting means; however, any means that accomplishes the desired result is satisfactory.

Figure 5:
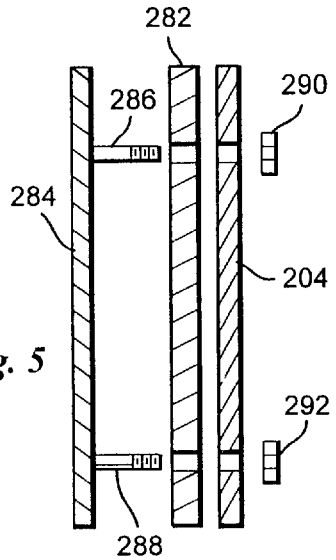
FIG. 5 is an exploded view in cross-section showing one means of securing the protective cover of the operating center to prevent its removal from outside the recycling center.

FIG. 5 depicts in cross-section one means for securing the polycarbonate sheet in the operating center. This means, which is merely one example, comprises a bar 284 to which bolts 286 and 288 are welded or otherwise mounted. The bolts extend through apertures in the polycarbonate and the wall 204 of the operating center and are secured in place by nuts or other keepers 290 and 292. All accessible edges of the polycarbonate are secured in the manner described or in any other manner to prevent removal of the polycarbonate sheet. The securement is inside the housing; thus, when the housing is closed and locked, the polycarbonate sheet cannot be removed.

Figure 6:
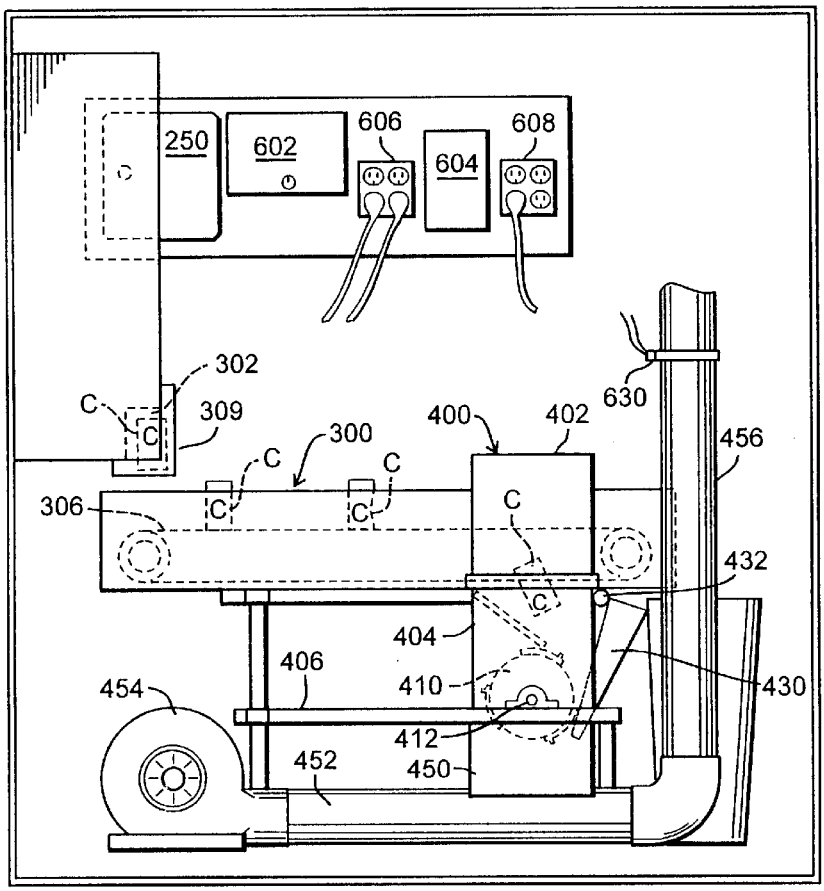
FIG. 6 depicts the interior elevation of the left half of the aluminum can recycling center of this invention taken from about the center of the housing looking to the left as viewed in FIG. 2.

Reference is now made to FIGS. 6. 7 and 8, in particular. The can sorter system 300 is generally as described in detail in my co-pending U.S. patent application Ser. No. 08/532,471, now U.S. Pat. No. 5,678,696 to which priority is claimed as to common subject matter. The can sorter and counter system 300 does, however, include one important improvement which is described hereinafter.

Figure 7:
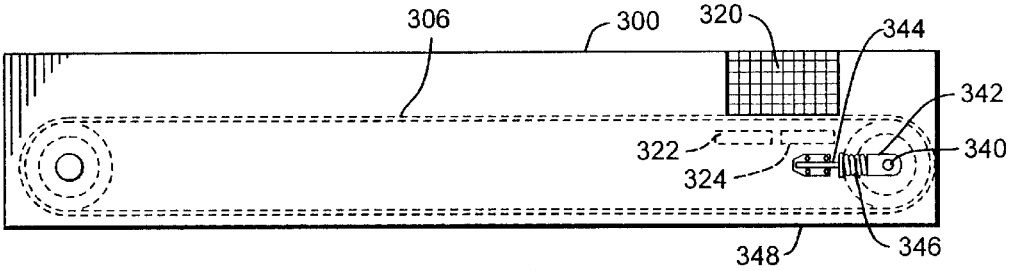
FIG. 7 is a side view of the aluminum can sorter used in the aluminum can recycling center of this invention showing an improvement thereof in detail.
Figure 8:
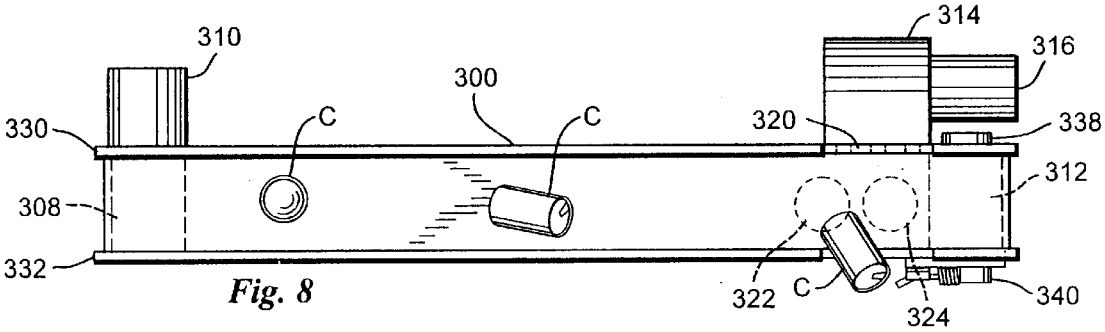
FIG. 8 is a top plan view of the aluminum can sorter shown in FIG. 7.

It is very important that the invention comprise a small, highly efficient and reliable aluminum can separator. The aluminum can separator 300 receives cans from the operating center as the user passes the cans through the opening 302 which is covered by a spaced cover 304 which directs the cans downwardly and prevents the user from reaching into the housing. The aluminum can separator comprises a conveyor belt 306 which receives the cans. The conveyor belt is mounted, as best shown in FIG. 8, on a pair of rollers 308, driven by motor 310, and 312. As the cans travel, to the right in the figures, they are subjected to a high velocity cross-wind produced by a blower 314 driven by a motor 316. The air flows through a protective grill or screen 320 and blows the aluminum cans off the belt and, as will be described, into the crusher. One or more magnets 322 and 324 positioned below the belt hold steel cans on the belt surface so they are not blown off. Steel cans and heavy objects such as rocks or bottles, etc., fall off the right end of the belt and are discarded. The rollers, motor, blower, etc., are supported by a frame that comprises a pair of side plates 330 and 332 secured in spaced relation as shown by any desired means. The roller 312 is mounted in a pair of special biased bearing assemblies, one of which is shown in FIG. 7. The bearing assembly 340 comprises a bearing 342 connected by a shank 344 upon which is received a spring and adjusting nut or keeper shown at 346 to an over-center fastener 348. This assembly permits the tension on the conveyor belt to be adjusted, by means of adjusting the compressed length of the spring, and quick release of the tension by means of the over-center fastener to permit changing of belts, etc. This adjustable tension mounting means is adjusted to assure that the belt will run true, i.e., not wander sideways on the rollers.

The progress of a number of cans, c, along the belt and off the belt into the crusher is shown in FIGS. 6 and 8. When the aluminum cans are blown off the belt, into the crusher 400, they are caught by a crusher cover box 402 from which they drop into the crusher and, after being crushed, drop through a guide receptor 450 into a pneumatic conduit 452 through which a high velocity of stream of air produced by blower 454 passes. The air stream carries the crushed cans through the pneumatic conduit 456 and past a can counter 630 and into the receptacle 500. The air conveyer system is not an integral part of the crusher, of course, but in the preferred embodiment is treated as part of the crusher system in that it is turned on and off with the crusher roller.

Figure 9:
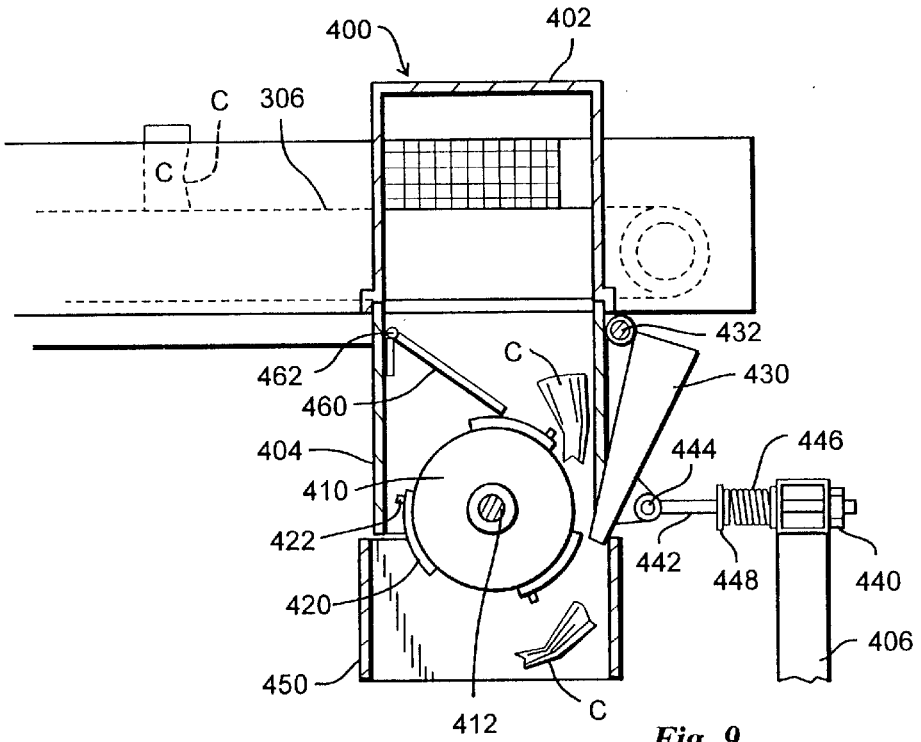
FIG. 9 is a side view, looking to the left as viewed in FIG. 2, showing in partial cross-section the crusher used in the aluminum can recycling center of this invention.

The crusher comprises a housing 404 supported by a frame 406, which also supports other components, a crusher drum 410 rotatably driven by a shaft 412, shown best in FIGS. 6 and 9. While any of several types of crusher drums may be used, on important optional feature of this invention comprises a plurality, usually three or four, arcuate segment or flat shoes mounted on the drum surface and projecting upwardly from the drum surface from about one-fourth to one inch above the drum surface. An important structure comprises one or more, generally two or three, projections 422 extending about one-fourth inch above the shoe. These projections may be formed integrally with the shoes, or in any other way. One convenient structure is formed by drilling a ¼ inch hole in the shoe and press-fitting a ¼ inch bolt segment into the hole so that the bolt extends about ¼ inch±⅛ inch from the shoe. The outer ends of the bolts are preferably rounded, however, the precise length or shape of the projection is not critical.

The cans are crushed between the crusher drum 410, the shoes 420 and an anvil member 430 which is mounted pivotally as shown at 432. The anvil has grooves 434 and 436, in such number and position as to receive the projections on the shoes so that the projections do not ride against the anvil. The anvil is strongly spring-biased toward the drum by a biasing assembly 440. The assembly 440 may, as an example only, comprise a shank 442 secured by pivot connector 444 to the anvil at one end, upon which is fitted a spring 446 and an adjustable nut or keeper 448. The assembly 440 is mounted to the frame 406, or any kind of frame member.

The provision of a spring biased, movable anvil is an important part of the invention. Sometimes, in spite of the efficiency of the aluminum can sorter, a hard object, such as a rock, may find its way into the crusher. Some times, a can may be crushed and bent in such a way that it adheres to the drum and another can may, temporarily, lodge on top of the first can, forming a hard object too large to pass the conventional crushing nip. In such cases, the nip opens and allows the object to pass through with damage to the drum.

The provision of the shoes and projections assures that every can will be grabbed and carried through the crushing nip between the drum and anvil. Without the projections, aluminum cans tended to bounce around in the housing above the drum. As the cans accumulated, they would eventually go through the crusher, sometimes jamming up two or three at once. The projection solved the problem, however. The cans are immediately impaled on the projection and carried through the crushing nip. There was a serious concern that the cans would not fall off the drum once impaled on the projections. It was found, however, that if the projection is from about ⅛ to ⅜ inch long, optimally about ¼ inch long, measured from the shoe, the cans nearly always fell off the drum. Once the ends of the projections were rounded, all of the cans fell of the drum. By "rounding" I mean filing or abrading the periphery of the projections. A hemispheric end is not required.

A guide sheet 460 prevents the cans from falling into the rear nip, i.e., the space on the left side of the drum as depicted rotating clockwise in FIG. 9. The guide sheet may be a flexible plastic or heavy fabric sheet which is inherently flexible or it may be relatively ridged and attached to the housing by hinges 462. The guide sheet is important. But for the presence of this element, the cans could fall on to the back side of the drum and simply bounce around or become a hard mass of a plurality of partially crushed cans. The guide means is movably mounted over approximately half of the crusher drum to prevent cans from entering the space on the side of the drum distal from the anvil. Preferably, the guide means slopes toward the anvil and contacts and is vibrated by the drum thereby bouncing any cans that may contact the guide means toward the anvil. The presence of this member assures that every can will be crushed.

Figure 11:
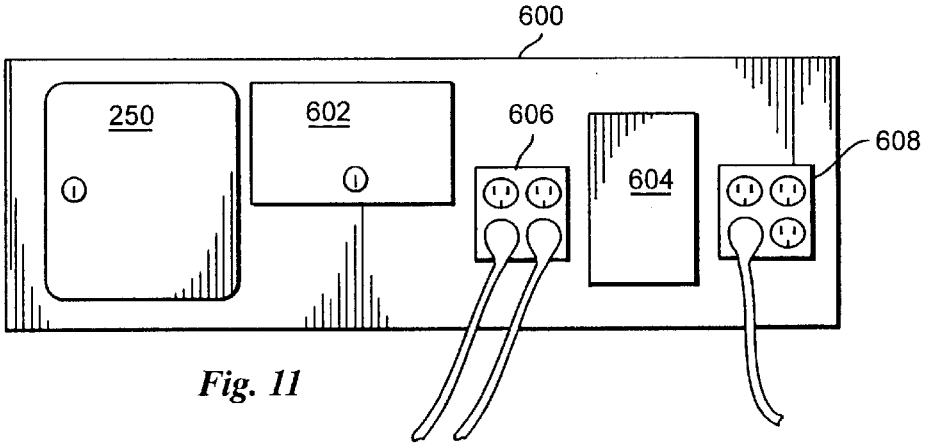
FIG. 11 is a front elevational view of the control center of the aluminum can recycling center of this invention showing of the control components located on a removable and replaceable central control board.

Referring now to FIG. 11, the entire electrical distribution and control systems are, preferably, mounted on a single board or central panel 600. This permits maintenance personnel to remove a central panel suspected of being defective and replace it with a central panel that has been rebuilt and/or tested and is known to be operational.

The central panel 600 may, for example, comprise a coin dispenser 250, a controller circuit housing 602, a switch box 604 to which a plurality of electrical outlets 606 and 608 are connected, some of which are switched to operate as described herein. The coin dispenser is not mounted on the door and is, therefore, less subject to vandalism than if it were on the door.

Figure 10:
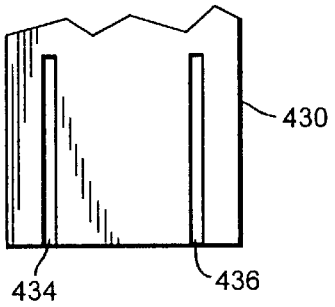
FIG. 10 is an enlarged view of the face of the anvil that is located adjacent the drum defining the crushing nip, partially cut away, showing grooves in the anvil of the crusher.

The aluminum can recycling center is controlled by a microprocessor system. Those skilled in the art can, as a matter of routine practice, design many such systems for controlling the aluminum can recycling center. One such example is shown in FIG. 10.

Figure 12:
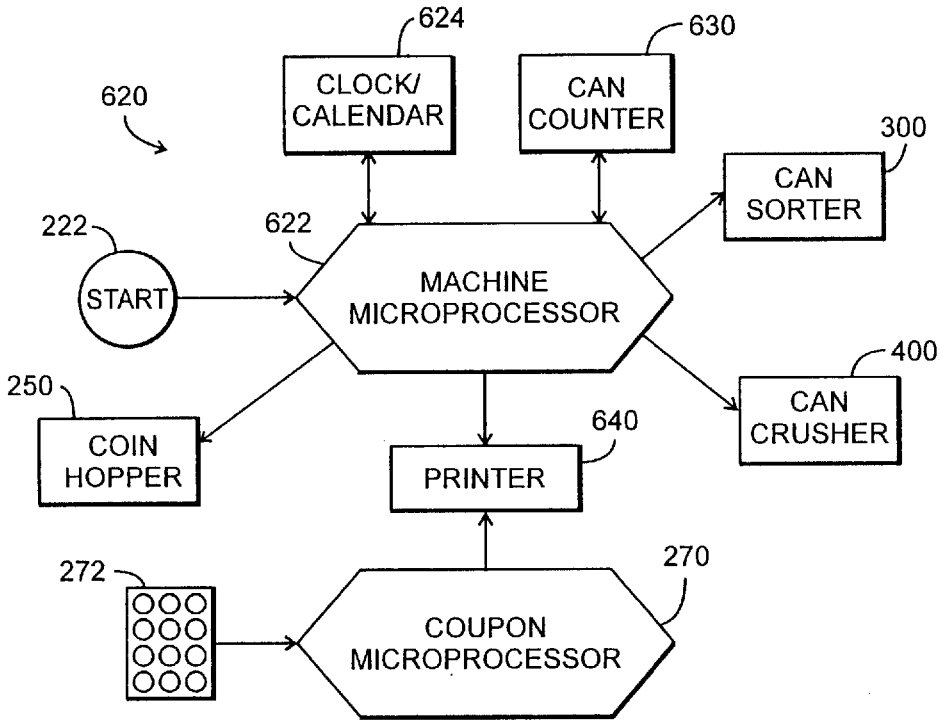
FIG. 12 is a functional block diagram of the controller for the aluminum can recycling center of this invention.

The main controller system 620, a functional diagram of which appears in FIG. 12, comprises a machine microprocessor 622 which receives input from the start button 222. When the start button 222 is pushed, the microprocessor turns on the can sorter 300 and can crusher 400, including the air conveyer 454. The can counter 630 is also turned on. The can counter is an induction counting system of conventional design. An exemplary induction counting system comprises a coil mounted around the pneumatic conduit 630, which is typically formed of plastic or aluminum, to which a steady state current or signal is fed. The current flow, applied voltage, applied signal or generated signal frequency or strength, or some other electrical signal that is dependent upon the inductive characteristics of the system is used as the reference. When an aluminum can is carried through the pneumatic conduit, the inductive characteristics of the steady state system are disrupted causing a peak change one or more electrical signals. Each such perturbation is counted and the count fed to the microprocessor. The clock/calendar is used to provide timing for data collection purposes and also to turn the system off if no cans are counted for a predetermined period of time. After a predetermined period of time from the last can counted has passed, the microprocessor calculates the amount of money to be paid and signals the coin hopper 250 to release coins totaling that amount which drop into the coin tray 252 or, at the option of the recycle center operator, issue a voucher printed on the printer 640 through the slot 642 to the user. Small payments can be made by coin and larger payments can be paid by voucher if desired. The voucher is usually made redeemable in the store or business establishment at which the recycle center is located. The owner of the establishment may elect to pay double or added value for the aluminum as an inducement for the user to shop in the business.

The user, whether or not depositing aluminum cans, can select coupons by entering the coupon number in the keypad 272. This number signal is processed by the coupon microprocessor 270 which causes the printer 640 to print out the desired coupons.

Figure 13:
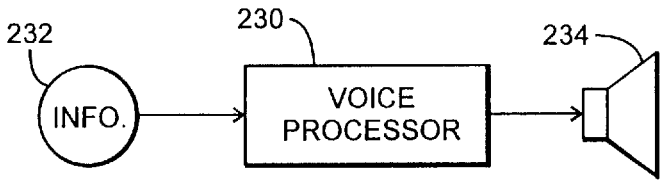
FIG. 13 is a functional block diagram of the audible verbal instruction system of this invention.

Referring briefly to FIG. 13, when the user presses the Info button 232, an audible, verbal message generated digitally or by analog recording by the voice processor 230 and played audibly by speaker 234 giving instructions for use and such other information as may be desired.

While any data handling and storage systems may be used, the preferred systems are digital microprocessors that access RAM, the contents of which can be changed at will by the recycle center operator. The RAM can be erased and new information record in the conventional way either in person or via modem and telephone line as the operator desires. Such systems are very well developed and widely used in a vast variety of environments from home computers to very sophisticated control systems. There is nothing unique, except the overall application as described, in the electronics and data handling.

There are, however, several unique features embodied in the invention.

The provision of a coupon dispenser that is essentially vandal proof and which allows the user to be compensated in advertising coupons, as well as cash payment for aluminum cans, provides a very important advantage. A merchant can, by placing advertisements for coupons in the aluminum can recycling center of this invention, invite users into the business establishment to make purchases. In addition, the merchant, or owner of the recycling center, can sell advertising space to others and dispense coupons that will encourage users of the recycling center to patronize the advertiser.

It has become common to use LCD and LED displays, video displays, etc. in publically available dispensing machines, etc. This practice is reasonable and safe where the machines are used in a controlled environment. The inclusion of such displays in devices that may be left unattended in low traffic areas for several hours at night invites vandalism, however. The display and dispensing of coupons and other advertisements in the manner described essentially eliminates vandalism.

The unique improvement to the aluminum can sorter is an important simplifying mechanism which makes such machines run longer and more reliably.

An improved crusher that obviates the risks of damage from stones and other hard objects that are inherent in crushing devices and assures that all cans will drop into the crushing nip properly is an important facet of the invention. The incorporation of projections on shoes on the crusher drum is a particular advantage that solves problems long tolerated for lack of a solution.

Additional advantages will be apparent from the specification and drawings and are encompassed in the claims.

INDUSTRIAL APPLICATION

This invention is useful in the aluminum recycling industry.

What is claimed is:

1. In an aluminum can recycling center comprising in combination a generally rectangular housing having ends and a front side and a back side, means for receiving, sorting and counting aluminum cans, means for crushing aluminum cans, means for transporting crushed aluminum cans to a recycle bin, and means responsive to the aluminum can counting means for dispensing payment to the user, the improvement wherein: the aluminum can sorter comprises a continuous conveyor belt carried on a pair of rollers, said housing comprising a bottom frame structure said bottom frame structure comprising end beams underlying the ends and side beams underlying the front side and the backside of the housing, and further comprising supporting means detachably secured to the housing frame structure, said supporting means comprising downwardly extending rolling casters for movably supporting the housing, and wherein one of the rollers is supported by a shaft mounted at each end by an over-center, spring biased bearing assembly, said over-center, spring biased bearing assemblies each comprise a bearing for the shaft, a bias spring on a shank, and an over-center fastener for applying biasing force to the spring and wherein an end beam of the housing is configured and constructed to define hollow ends and further comprising a towing member comprising a beam having hollow ends, said towing member beam being configured and constructed to be removably secured at each end into said hollow ends of said housing beam, said towing member further comprising a handle extending generally perpendicular from said towing member beam, and a pair of U-shaped fasteners constructed and configured to extend into the respective hollow ends of the housing beam and the towing beam for securing the towing member to the housing.

2. In an aluminum can recycling center comprising in combination a generally rectangular housing having ends and a front side and a back side, means for receiving, sorting and counting aluminum cans, means for crushing aluminum cans, means for transporting crushed aluminum cans to a recycle bin, and means responsive to the aluminum can counting means for dispensing payment to the user, the improvement comprising: a plurality of coupon advertising spaces for receiving printed coupon advertisements, a substantially unbreakable transparent cover for the displays, means securing the cover over the displays for preventing removal of the cover except by authorized individuals, and means for being activated by a user for dispensing coupons selected by the user, said housing comprising a bottom frame structure said bottom frame structure comprising end beams underlying the ends and side beams underlying the front side and the backside of the housing, and further comprising supporting means detachably secured to the housing frame structure, said supporting means comprising downwardly extending rolling casters for movably supporting the housing, and wherein an end beam of the housing is configured and constructed to define hollow ends and further comprising a towing member comprising a beam having hollow ends, said towing member beam being configured and constructed to be removably secured at each end into said hollow ends of said housing beam, said towing member further comprising a handle extending generally perpendicular from said towing member beam, and a pair of U-shaped fasteners constructed and configured to extend into the respective hollow ends of the housing beam and the towing beam for securing the towing member to the housing.

3. In an aluminum can recycling center comprising in combination a generally rectangular housing having ends and a front side and a back side, means for receiving, sorting and counting aluminum cans, means for crushing aluminum cans, means for transporting crushed aluminum cans to a recycle bin, and means responsive to the aluminum can counting means for dispensing payment to the user, the improvement wherein: the aluminum can sorter comprises a continuous conveyor belt carried on a pair of rollers, said housing comprising a bottom frame structure said bottom frame structure comprising end beams underlying the ends and side beams underlying the front side and the backside of the housing, and further comprising supporting means detachably secured to the housing frame structure, said supporting means comprising downwardly extending rolling casters for movably supporting the housing, and wherein an end beam of the housing is configured and constructed to define hollow ends and further comprising a towing member comprising a beam having hollow ends, said towing member beam being configured and constructed to be removably secured at each end into said hollow ends of said housing beam, said towing member further comprising a handle extending generally perpendicular from said towing member beam, and a pair of U-shaped fasteners constructed and configured to extend into the respective hollow ends of the housing beam and the towing beam for securing the towing member to the housing.

4. An aluminum can recycling center comprising in combination a generally rectangular housing having ends and a front side and a back side, means for receiving, sorting and counting aluminum cans, means for crushing aluminum cans, means for transporting crushed aluminum cans to a recycle bin, and means responsive to the aluminum can counting means for dispensing payment to the user, said housing comprising a bottom frame structure said bottom frame structure comprising end beams underlying the ends and side beams underlying the front side and the backside of the housing, and supporting means detachably secured to the housing frame structure, said supporting means comprising downwardly extending rolling casters for movably supporting the housing and wherein an end beam of the housing is configured and constructed to define hollow ends and further comprising a towing member comprising a beam having hollow ends, said towing member beam being configured and constructed to be removably secured at each end into said hollow ends of said housing beam, said towing member further comprising a handle extending generally perpendicular from said towing member beam, and a pair of U-shaped fasteners constructed and configured to extend into the respective hollow ends of the housing beam and the towing beam for securing the towing member to the housing.

5. In an aluminum can recycling center comprising in combination:

(a) a generally rectangular housing having ends and a front side and a back side, (b) means for receiving, sorting and counting aluminum cans, (c) means for crushing aluminum cans, (d) means for transporting crushed aluminum cans to a recycle bin, and (e) means responsive to the aluminum can counting means for dispensing payment to the user, the improvement comprising:

(f) a plurality of coupon advertising spaces for receiving printed coupon advertisements, (g) a substantially unbreakable transparent cover for the displays, (h) means securing the cover over the displays for preventing removal of the cover except by authorized individuals, (i) means for being activated by a user for dispensing coupons selected by the user housing, said housing comprising (j) at least one door for opening the housing, said door having a front side facing outside the housing and a back side facing inside the housing when the door is closed, (k) said coupon advertising spaces being mounted in the door, (l) the substantially unbreakable transparent cover for the coupon advertising spaces comprising a sheet of transparent polycarbonate at least about ⅛ inch thick configured to cover the coupon advertisements, and (m) the means securing the cover over the displays for preventing removal of the cover comprising a frame mounted by screws the heads of which are not accessible from outside the housing, said screws being configured, constructed and disposed to be loosened only from the back side of the door.

6. The aluminum can recycling center of claim 5 wherein said housing comprises a bottom frame structure, said bottom frame structure comprising end beams underlying the ends of the housing and side beams underlying the front side and the back side of the housing, at least one end beam of the housing being configured and constructed to define hollow ends, and further comprising (n) supporting means detachably secured to the bottom frame structure of the housing, said supporting means comprising downwardly extending rolling casters for movably supporting the housing, (o) a towing member comprising a beam having hollow ends, said towing member beam being configured and constructed to be removably secured at each end into said hollow ends of said housing beam, said towing member further comprising a handle extending generally perpendicular from said beam, and (p) a pair of U-shaped fasteners constructed and configured to extend into the respective hollow ends of the housing beam and the towing beam for securing the towing member to the housing.

* * * * *